US007294801B2

(12) United States Patent
Shimizu

(10) Patent No.: US 7,294,801 B2
(45) Date of Patent: Nov. 13, 2007

(54) SWITCHING DEVICE

(75) Inventor: Keiichi Shimizu, Kasugai (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 11/387,108

(22) Filed: Mar. 22, 2006

(65) Prior Publication Data

US 2007/0023269 A1 Feb. 1, 2007

(30) Foreign Application Priority Data

Aug. 1, 2005 (JP) ..... 2005-223025

(51) Int. Cl.
*H01H 9/00* (2006.01)

(52) U.S. Cl. ..... 200/302.3; 200/293; 200/302.1

(58) Field of Classification Search ..... 200/1 B, 200/4, 5 R, 5 A, 17 R, 18, 339, 302.1, 302.2, 200/302.3, 293, 341
See application file for complete search history.

(56) References Cited

U.S. PATENT DOCUMENTS

| | | | | |
|---|---|---|---|---|
| 5,117,074 | A * | 5/1992 | Yanai et al. | 200/302.3 |
| 5,647,478 | A | 7/1997 | Hirai | |
| 5,824,981 | A * | 10/1998 | Suzuki | 200/302.1 |
| 5,876,243 | A * | 3/1999 | Sangawa | 439/519 |
| 6,156,983 | A * | 12/2000 | Chen et al. | 200/302.1 |
| 6,443,644 | B1 * | 9/2002 | Takeda et al. | 400/490 |
| 6,911,612 | B2 * | 6/2005 | Seki | 200/339 |
| 7,084,359 | B1 * | 8/2006 | Konno | 200/1 B |

FOREIGN PATENT DOCUMENTS

| | | |
|---|---|---|
| JP | 58-26131 | 8/1981 |
| JP | 62-25441 | 2/1987 |
| JP | 3-48322 | 5/1991 |
| JP | 5-6605 | 1/1993 |
| JP | 5-314864 | 11/1993 |
| JP | 9-204842 | 8/1997 |
| JP | 3111221 | 9/2000 |
| JP | 2004-319539 | 11/2004 |

OTHER PUBLICATIONS

Patent Abstracts of Japan, Publication No.: 05-314864, Publication Date: Nov. 26, 1993, 1 page.
Japanese Office Action for Japanese Patent Application No. 2005-223025, dated May 31, 2007, and English translation thereof, 8 pages.

* cited by examiner

*Primary Examiner*—Michael A Friedhofer
(74) *Attorney, Agent, or Firm*—Osha Liang LLP

(57) ABSTRACT

A switching device has a switch, a case within which the switch is accommodated, a cylinder which is provided on an upper surface of the case and open to above and below to communicate with the inside of the case, an operation knob which covers an opening of the cylinder and swings in a front-to-rear direction, and an operation bar which extends from the operation knob through the opening into the case to transmit the motion of the operation knob to the switch. A guide member is disposed between the case upper surface and the end of the operation knob. The guide member is inclined in the left and right directions so as to guide water toward the sides of the case.

18 Claims, 11 Drawing Sheets

SWITCHING DEVICE

BACKGROUND OF THE INVENTION

1. Field of the Invention

The present invention relates to a switching device for switching on and off by operation of an operation knob which swings, and more particularly to a waterproof-type switching device which is capable of preventing water from entering into its case.

2. Description of Related Art

A switching device used in a vehicle window open/close system (power window system) is provided on an arm rest of a door, a console at the center, or other positions of an automobile. This type of switching device has a switch, a circuit board and other components accommodated inside a case, and a cylinder which is disposed on the upper surface of the case and opens to above and below to communicate with the inside of the case, as disclosed in JP-A-8-180755 and JP-A-5-314864 (Patent References 1 and 2). An operation knob is attached to the cylinder in such a position as to cover the upper opening of the cylinder and in such a manner as to swing on the cylinder in the front-to-rear direction. An operation bar which is connected with the operation knob penetrates through the opening of the cylinder and extends toward the inside of the case so as to transmit the movement of the operation knob to the switch. When the operation knob is operated, its swinging motion in the front-to-rear direction is transmitted through the operation bar to the switch so that the switch is turned on or off in accordance with the swinging motion of the operation knob.

In a typical switching device of this type, a cover for covering the upper surface of the case is attached. The operation knob is exposed through an opening of the cover such that the operation knob can be operated therethrough. Thus, when some raindrops fall on the cover in case of raining or for other reasons, the raindrops scarcely enter into the case of the switching device. However, when a large volume of beverage or the like (hereinafter referred to as "water") is spilt over the cover, the water enters through the clearance between the opening of the cover and the operation knob and flows downward to the upper surface of the case, reaching the cylinder or other components. The water having reached the cylinder rises through the clearance between the operation knob and the cylinder by the force of flow, and enters through the opening of the cylinder into the case. The water having entered the case may cause corrosion and short-circuit of the switch and circuit board.

Japanese Patent No. 3111221 (Patent Reference 3) discloses a method for preventing entrance of water as in the above case. According to this method, water catching grooves are formed on the upper surface of the case before and after a cylinder. The bottoms of the grooves are inclined toward the front of the case, and/or are mountain-shaped having a watershed at the center. Drain ports penetrating through the deepest portions of the water catching grooves are formed on the front surface and the sides of the case. Nothing is described about prevention of water entrance in Patent References 1 and 2.

According to the method of Patent Reference 3, water having entered through the clearance between a cover (finisher according to the description of Patent Reference 3) and the operation knob toward the upper surface of the case is introduced into the water catching grooves to be captured therein. The water is then guided along the inclined groove bottoms toward the deepest portions at the front, and is discharged through the drain ports which are disposed on the sides of the case and are relatively smaller in size than the width and depth of the water catching grooves. Thus, when the amount of water is large, the water having flowed into the water catching grooves cannot be sufficiently discharged through the drain ports. As a result, water overflows the water catching grooves and goes toward the cylinder. The water having reached the cylinder rises through the clearance between the operation knob and the cylinder and enters into the case in some cases.

SUMMARY OF THE INVENTION

Accordingly, it is an object of the invention to provide a switching device capable of preventing entrance of water from the outside through an opening of a cylinder into a case.

A switching device according to the invention includes: a switch; a case within which the switch is accommodated; a cylinder which is provided on the upper surface of the case and open to above and below to communicate with the inside of the case; an operation knob which covers the opening of the cylinder and swings in the front-to-rear direction; and an operation bar which extends from the operation knob through the opening into the case to transmit the motion of the operation knob to the switch. A guide member is disposed between the case upper surface and the end of the operation knob and is inclined in the left and right directions so as to guide water toward the sides of the case.

In this structure, the guide member may be inclined downward both in the left direction and right direction, or may be inclined downward only in either of these directions.

In this structure, when water enters from the outside and falls on the case upper surface in the vicinity of the front end of the operation knob, the water flows along the guide member to be discharged to the left and right sides of the case as necessary. Accordingly, water is prevented from rising through the clearance between the operation knob and the cylinder and entering through the opening of the cylinder into the case. Particularly, the width in the left-to-right direction of a switching device used in a power window system or the like is generally shorter than the width thereof in the front-to-rear direction, and the distance from the cylinder to the left and right side surfaces is shorter than the distance from the cylinder to the front and rear side surfaces. Thus, water can be quickly discharged from the case to the outside by introducing water along the guide member to the left and right sides of the case as described above. Accordingly, entrance of water into the case can be more securely prevented.

In an embodiment according to the invention, the guide member has a mountain-like shape which is inclined downward in both the left and right directions.

In this structure, water flows along the guide member both in the left direction and right direction while promptly staying away from the upper opening of the cylinder and the lower end of the operation knob. Accordingly, entrance of water into the case can be further prevented.

In an embodiment according to the invention, either the front end or the rear end of the guide member is disposed on the cylinder side with respect to the end of the operation knob and the other end of the guide member is disposed on the side opposite to the cylinder side with respect to the end of the operation knob.

In this structure, the guide member is positioned immediately below the end of the operation knob. Thus, water falling along the end of the operation knob directly drops on the guide member, and then promptly flows along the guide member toward the sides of the case. Accordingly, water is difficult to flow toward the cylinder, and thus entrance of water into the case can be further prevented.

In an embodiment according to the invention, either the front end or the rear end of the guide member is disposed adjacent to the side surface of the cylinder, and a flange projecting toward the other end of the guide member is provided on the side surface of the cylinder above the guide member.

In this structure, water flows along the guide member to the sides of the case without staying in the space between the guide member and the cylinder. Additionally, even when water on the guide member collides with the side surface of the cylinder and rises therefrom, the flange can prevent the water from passing through the clearance between the operation knob and the cylinder and reaching the upper opening of the cylinder. Accordingly, entrance of water into the case can be further prevented.

In an embodiment according to the invention, a groove having an open end to communicate with left and right side surfaces of the case is formed adjacent to the guide member.

In this structure, when water rises in directions other than the guiding direction of the guide member, i.e., the downward diagonal direction due to the dropping force of the water caused by splashing on the guide member, the water enters into the groove provided in the directions other than the guiding direction and does not return to the guide member. The water reaching the groove is then discharged through the open ends of the groove toward the left and right sides of the case. Accordingly, entrance of water into the case can be further prevented.

In an embodiment according to the invention, the case upper surface in the vicinity of the guide member is inclined downward to the left and right side surfaces of the case.

In this structure, water flowing along the guide member toward the case upper surface in the vicinity of the guide member does not stay on the case upper surface but flows along the inclined case upper surface. Accordingly, water can be easily discharged toward the sides of the case, and thus entrance of water into the case can be further prevented.

In an embodiment according to the invention, a concave is formed on the case in the vicinity of the end of the operation knob, and the guide member is disposed within the concave.

In this structure, a sufficient space is provided between the case upper surface and the end of the operation knob without raising the attachment position of the operation knob to somewhere above the case. Accordingly, the height can be reduced and the switching device can be thus miniaturized.

According to the invention, when water enters from the outside and falls on the case upper surface in the vicinity of the operation knob, the water flows along the guide member to be discharged to the left and right sides of the case as necessary. Accordingly, water is prevented from rising through the clearance between the operation knob and the cylinder and entering through the opening of the cylinder into the case.

DESCRIPTION OF PREFERRED EMBODIMENTS

Figure 1:
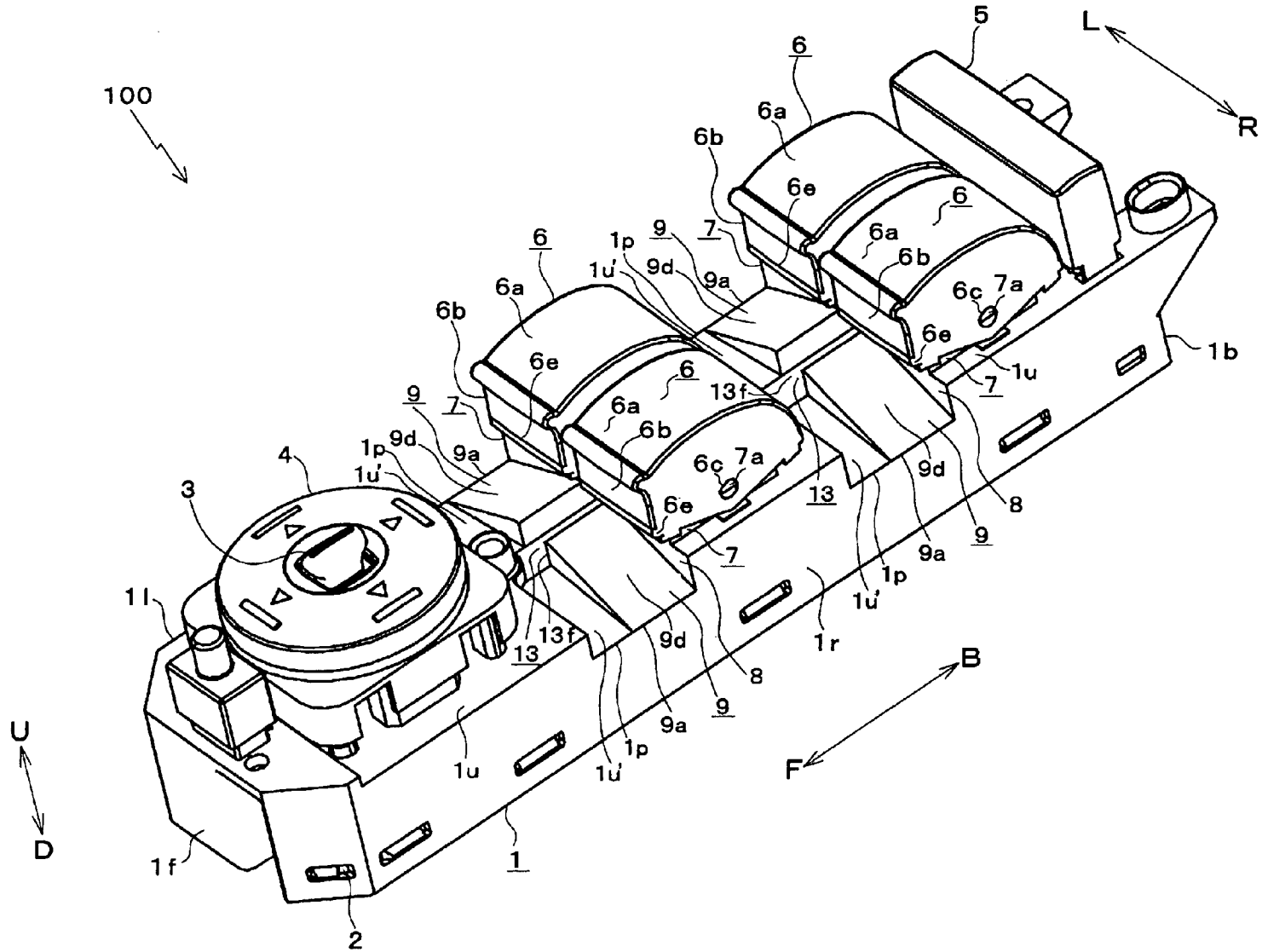
FIG. 1 is a perspective view of a switching device in an embodiment according to the invention.
Figure 2:
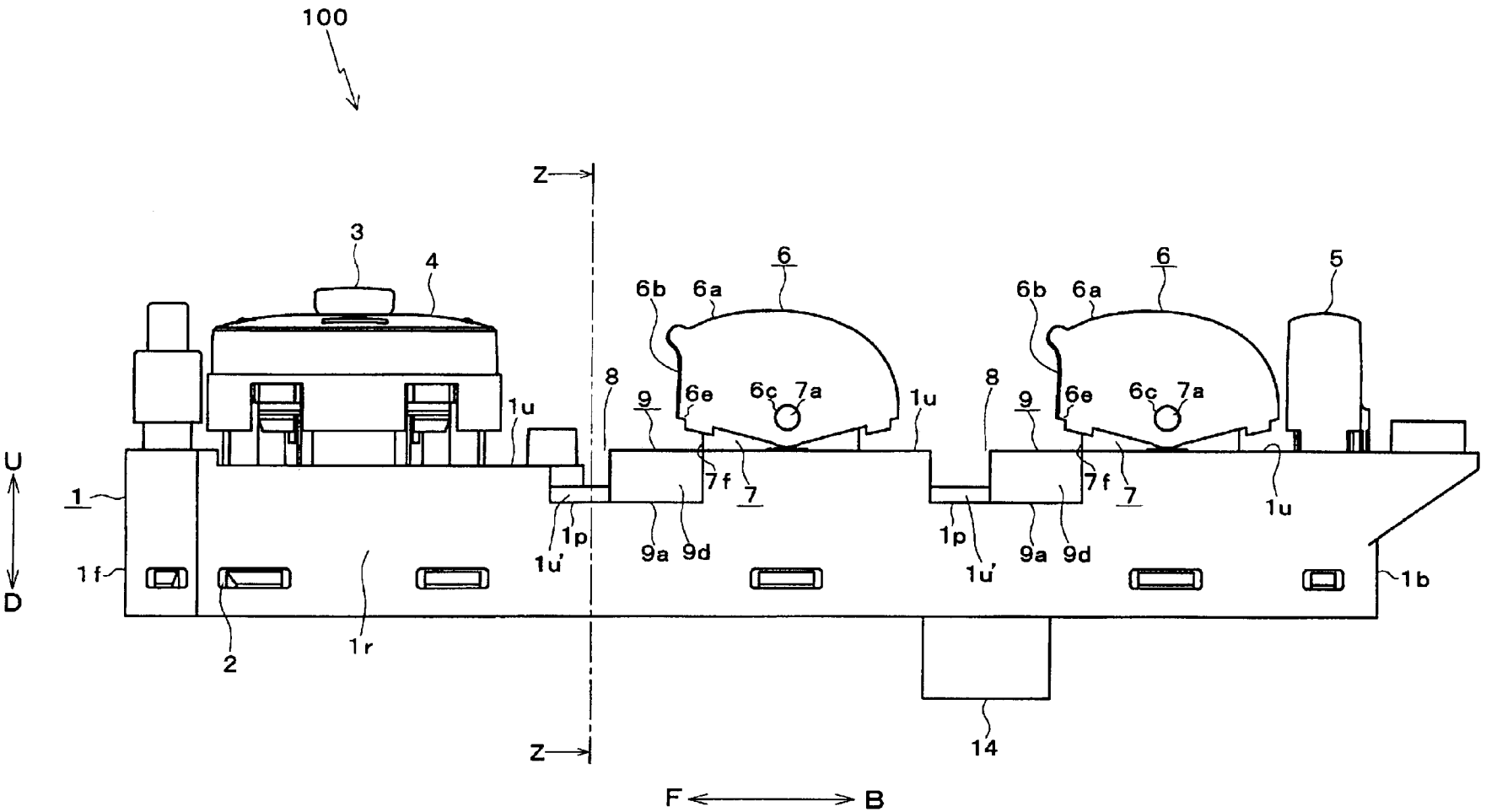
FIG. 2 is a right side view of the switching device.
Figure 3:
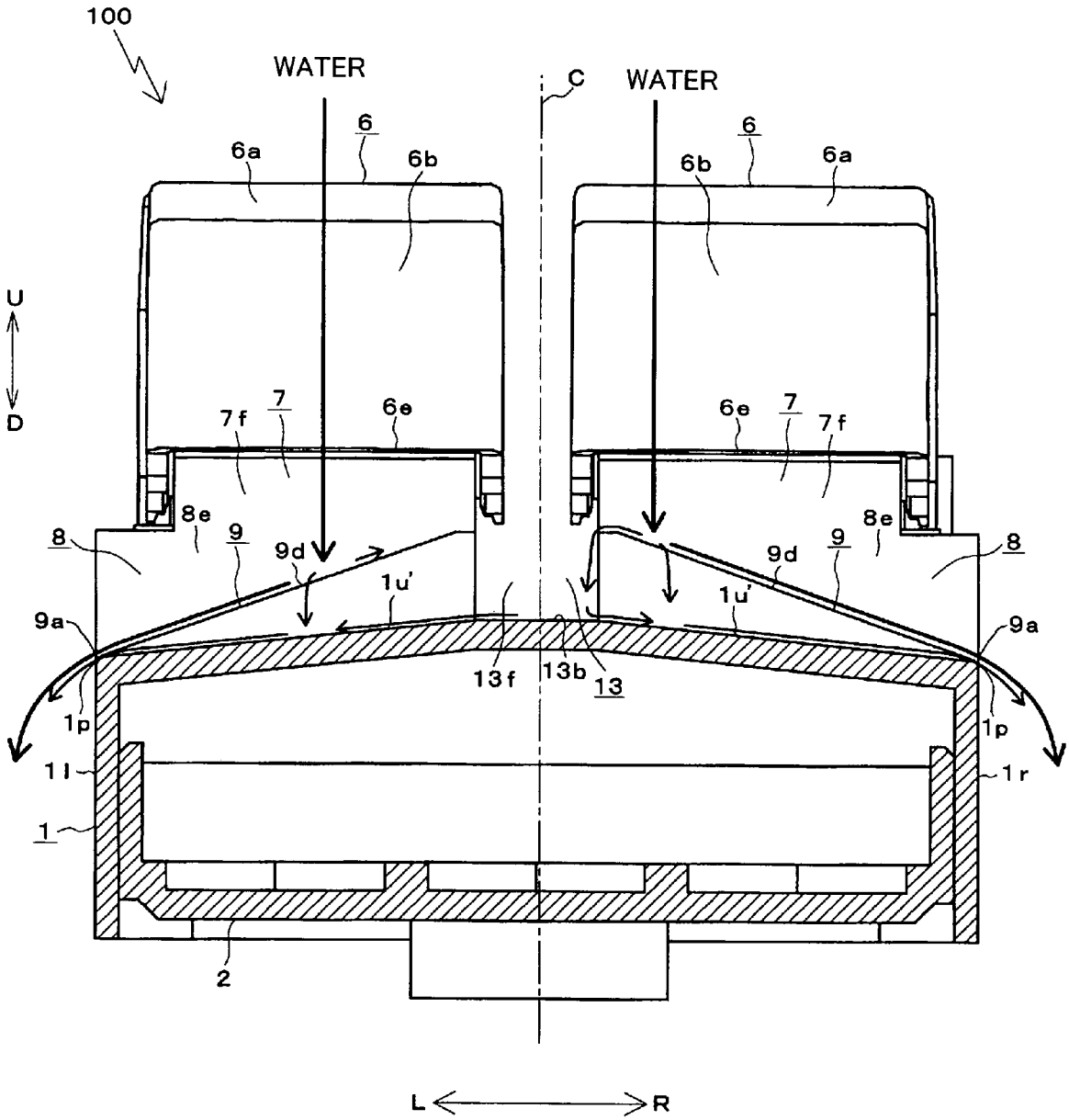
FIG. 3 is a front cross-sectional view of the switching device.
Figure 4:
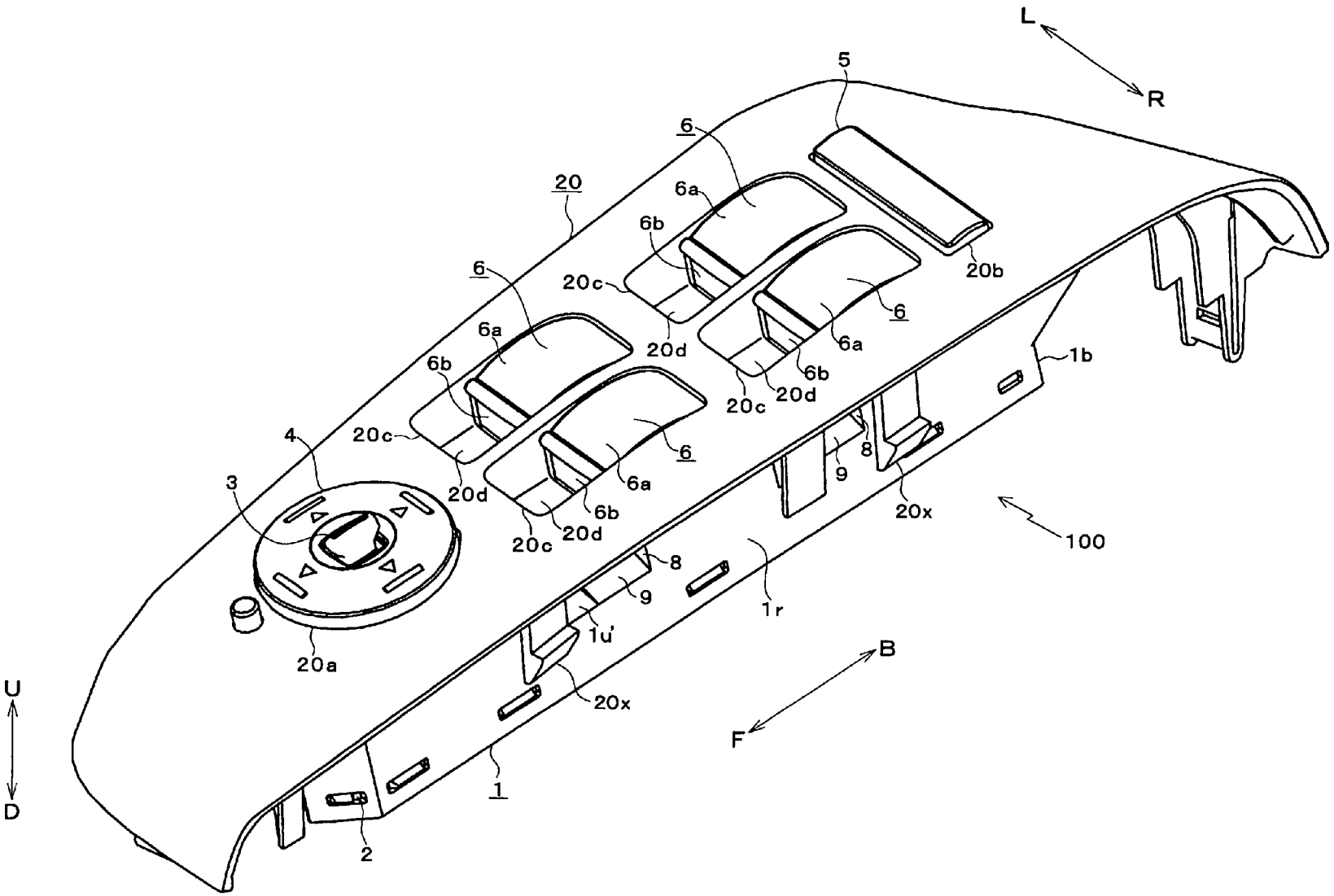
FIG. 4 is a perspective view of the switching device to which a cover is attached.
Figure 5:
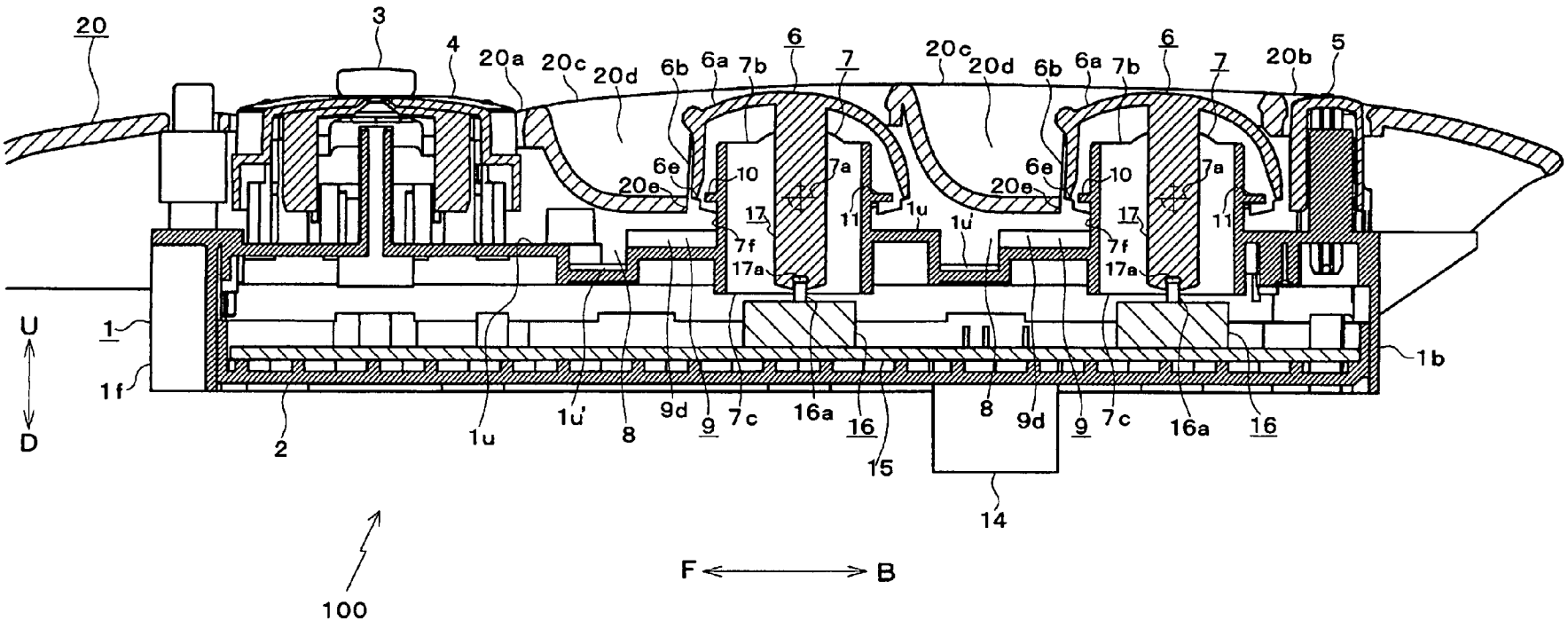
FIG. 5 is a side cross-sectional view of the switching device in the condition in FIG. 4.
Figure 6:
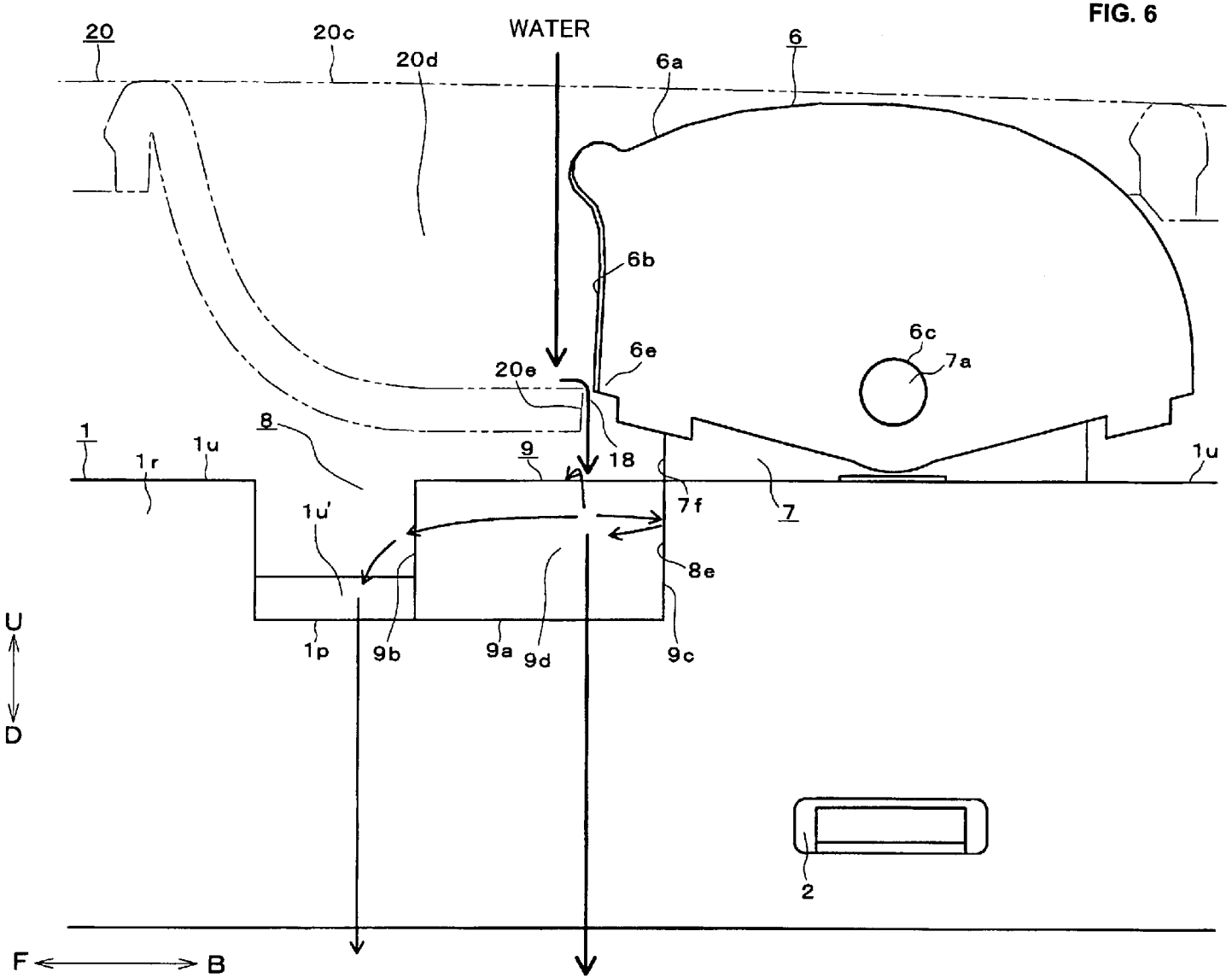
FIG. 6 is a side view showing a main part of the switching device in the condition in FIG. 4.
Figure 7:
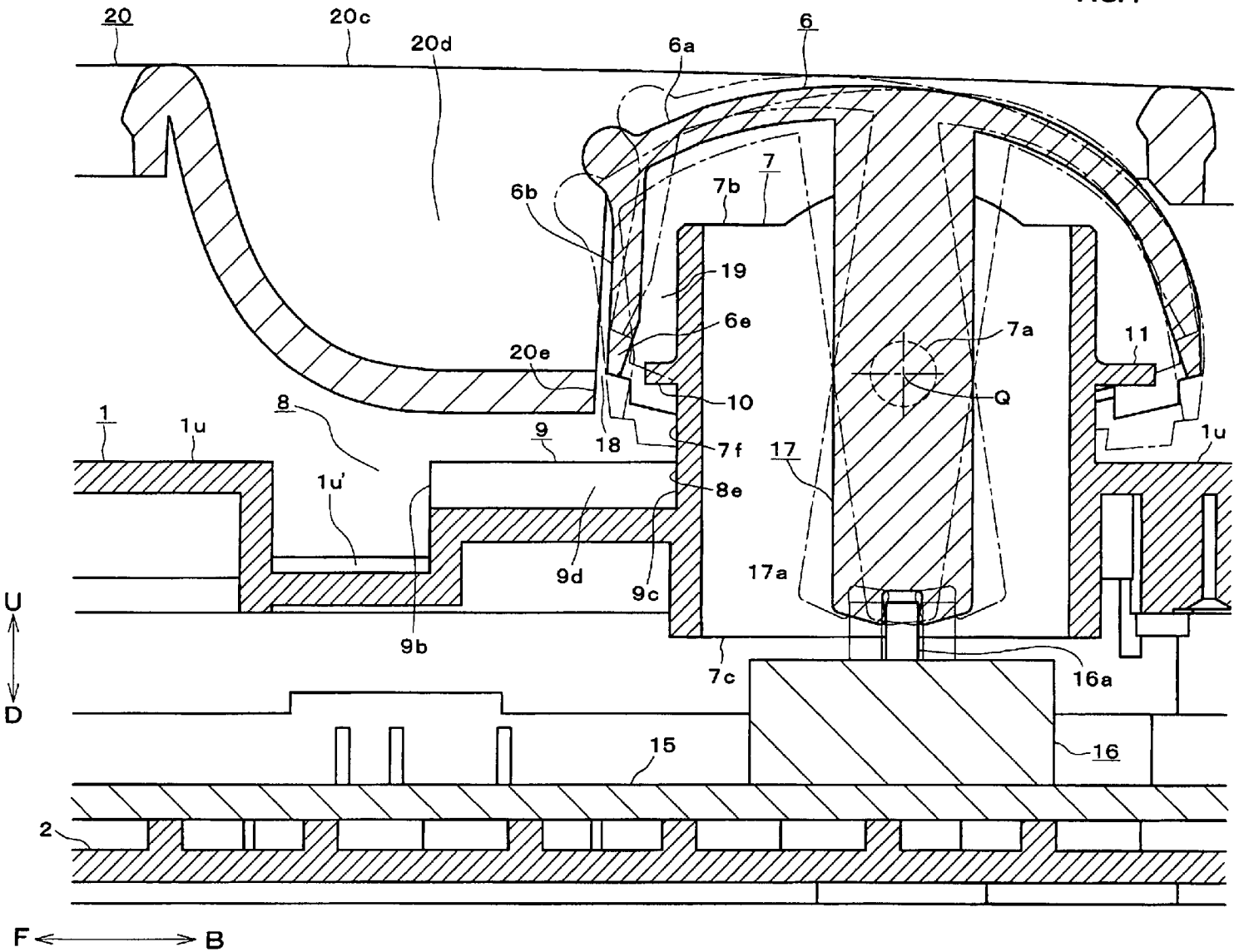
FIG. 7 is a side cross-sectional view showing a main part of the switching device in the condition in FIG. 4.

An embodiment according to the invention is hereinafter described with reference to the drawings. FIG. 1 is a perspective view of a switching device 100 in the embodiment according to the invention. FIG. 2 is a right side view of the switching device 100. FIG. 3 is a front cross-sectional view of the switching device 100 (taken along a line Z-Z in FIG. 2). FIG. 4 is a perspective view of the switching device 100 to which a cover 20 is attached. FIG. 5 is a side cross-sectional view showing the condition in FIG. 4. FIG. 6 is a side view showing a main part of the condition in FIG. 4. FIG. 7 is a side cross-sectional view showing the main part of the condition in FIG. 4.

As illustrated in FIG. 1 or other figures, the switching device 100 is used in a power window system and attached to an arm rest (not shown) provided on a door of a driver's seat of a vehicle. A case 1 of the switching device 100 has a rectangular shape having a left-to-right width L-R shorter than a front-to-rear width F-B, similarly to a case of a switching device used in a typical power window system. The case 1 has an upper surface 1*u*, a front side surface 1*f*, a rear side surface 1*b*, a left side surface 1*l*, and a right side surface 1*r*. As illustrated in FIGS. 5 and 7, components such as a circuit board 15 and switches 16 are accommodated inside the case 1. In FIG. 3, components and the like inside the case 1 are not shown. As illustrated in FIG. 5, the case 1 is open to below (in the D direction), and is closed by engagement with a lower cover 2. A connector 14 packaged on the circuit board 15 projects from the lower cover 2 toward below. A cable to be connected with a not-shown controller engages with the connector 14 so that output signals of the switches 16 or the like can be transmitted from the switching device 100 to the controller. As illustrated in FIGS. 4 and 5, the cover 20 is attached to the case 1 by screws (not shown) to cover the upper surface 1*u*. The cover 20 is attached to the arm rest of the door by fitting hook pieces 20*x* thereto or by other methods.

As illustrated in FIG. 1 or other figures, a slide-type first operation knob 3 and a four-point push-type (cross-shaped key type) second operation knob 4 of a mirror control switch are provided in the front region (in the F direction) of the upper surface 1*u* of the case 1. The first and second operation knobs 3 and 4 are operated to control the angles of left and right side mirrors of the vehicle. An operation knob 5 disposed in the rear region (in the B direction) is a push-lock-type operation knob of a window lock switch. The operation knob 5 is operated to lock the window of the vehicle such that the windows cannot be opened or closed, and to release the lock. Four seesaw-motion type operation knobs 6 of window open/close switches are disposed in the middle part, and operated to open and close the respective windows of the vehicle. Each of the operation knobs 6 has an operation section 6*a*, a cap section 6*b* formed integrally with the operation section 6*a*, and holes 6*c* formed on the outer sides of the cap section 6*b*. While one hole 6*c* on the right side (in the R direction) of each operation knob 6 is shown in FIGS. 1 and 2, the hole 6*c* is actually formed on both the right side surface and left side surface (side surface in the L direction) of each operation knob 6.

As illustrated in FIGS. 5 through 7, the operation knobs 6 are attached to hollow cylinders 7 disposed on the upper surface 1*u* of the case 1. More specifically, the cylinders 7 have a substantially rectangular horizontal cross section, and open to above and below (in the U and D directions) to communicate with the inside of the case 1. Shafts 7*a* are formed integrally with the left and right outer side surfaces of the cylinders 7. While two cylinders 7 are shown in FIG. 5, four cylinders 7 corresponding to the respective operation knobs 6 are actually provided (FIG. 1). Cap sections 6*b* of the operation knobs 6 are attached to the cylinders 7 from above to cover upper openings 7*b* of the cylinders 7, and the holes 6*c* of the operation knobs 6 are brought into engagement with the left and right shafts 7*a*. By this engagement, the operation knobs 6 are supported by the cylinders 7 such that the operation knobs 6 can swing in the front-to-rear direction around the shafts 7*a*. In addition to the cylinders 7, cylinders for attaching the operation knobs 3 through 5 are also provided on the upper surface 1*u* of the case 1, but those cylinders are not depicted nor described herein.

Operation bars 17 formed integrally with the inside surfaces of the operation knobs 6 project and penetrate through the cylinders 7. The operation bars 17 extend from the operation knobs 6 through the upper openings 7*b* of the cylinders 7 into the case 1. Concaves 17*a* are formed at the lower ends of the operation bars 17. The concaves 17*a* engage with actuators 16*a* of the switches 16 packaged on the circuit board 15. The switches 16 are switches for opening and closing the windows, and are formed by known slide switches. When the operation knobs 6 are lowered toward the front or raised toward the back by the finger, the operation knobs swing in the front-to-rear direction around the shafts 7*a* as shown by alternate long and short dash lines in FIG. 7. Then, the motions of the operation knobs 6 are transmitted through the operation bars 17 to the actuators 16*a*, and the switches 16 are turned on or off in accordance with the transmitted motions. More specifically, contacts equipped inside the switches 16 are switched between ON (continuity) and OFF (non-continuity) in accordance with the operating positions of the operation knobs 6. A point Q is the center point of each shaft 7*a*, i.e., the rotation center point of each operation knob 6. Other switches for mirror control, window open/close lock, and for other purposes are also packaged on the circuit board 15 as well as the switches 16, but those switches are not depicted nor described herein.

As illustrated in FIG. 4, in the condition where the cover 20 is attached to the case 1, the respective operation knobs 3 through 6 are exposed through openings 20*a* through 20*c* formed on the cover 20 such that the operation knobs 3 through 6 can be operated by the finger. The operation knob 3 can be operated only by sliding the operation knob 3 in the left-to-right direction on the operation knob 4. The operation knobs 4 and 5 can be operated only by pushing the operation knobs 4 and 5 from above. Thus, the opening areas of the openings 20*a* and 20*b* are small. However, since the operation knobs 6 are lowered toward the front or raised toward the back while putting the finger on the operation sections 6*a*, the opening areas of the openings 20*c* are formed large enough to allow the finger to be inserted into the openings 20*c*. As illustrated in FIGS. 5, 7 and other figures, concaves 20*d* for accommodating the operation knobs 6 and the cylinders 7 are provided below the openings 20*c*.

As illustrated in FIG. 1 and other figures, concaves 8 are formed in the vicinity of front ends 6*e* of the operation knobs 6 on the case 1, extending in the left-to-right direction L-R of the case 1. As illustrated in FIG. 3, upper surfaces 1*u*' of the case 1 constituting the bottoms of the concaves 8 (hereinafter referred to as "case upper surfaces 1*u*') are inclined downward toward the left and right side surfaces 1*l* and 1*r* of the case 1 and connected to the left and right side surfaces 1*l*, 1*r* of the case 1, providing open ends 1*p* at the ends of the side surfaces 1*l* and 1*r*. Four guide members 9 as wedge-shaped projections as viewed from the front are formed integrally with the case 1 in spaces between the case upper surface 1*u*' and the front ends 6*e* of the operation knobs 6. Thus, the concave 8 is formed on the case 1 such that the guide members 9 can be provided therein, that is to provide spaces for accommodating the guide members 9 between the case upper surface 1*u*' and the operation knobs 6. The guide members 9 have slopes 9*d* looking diagonally upward with downward inclination in the left and right directions L and R. The slopes 9*d* are connected to the left side surface 1*l* and the right side surface 1*r* of the case 1, providing open ends 9*a* at the ends of the side surfaces 1*l* and 1*r*. As illustrated in FIG. 3, the pair of the guide members 9 disposed in the left-to-right direction L-R are line-symmetric with respect to a center line C of the case 1 and form a substantially mountain shape. The guide members 9 guide water along the slopes 9*d* toward the left and right sides of the case 1.

The guide members 9 have front and rear ends 9*b* and 9*c*. As illustrated in FIGS. 6 and 7, the rear ends 9*c* are disposed on the cylinders 7 side (in the B direction) with respect to the front ends 6*e* of the operation knobs 6 and ends 20*e* of the concaves 20*d* of the cover 20. The rear ends 9*c* are positioned adjacent to front side surfaces 7*f* of the cylinders 7 and rear side surfaces 8*e* of the concaves 8 in the same planes as the front side surfaces 7*f*. The front ends 9*b* are disposed on the side opposite to the cylinders 7 side (in the F direction) with respect to the ends 6*e* and 20*e*. That is, the distance between the front ends 9*b* and the ends 6*e* and 20*e* is larger than the distance between the rear ends 9*c* and the ends 6*e* and 20*e*. Thus, the slopes 9*d* of the guide members 9 are positioned immediately below clearances 18 between the front ends 6*e* of the operation knobs 6 and the ends 20*e* of the cover 20. The clearances 18 are so sized that no trouble is caused at the time of swinging motions of the operation knobs 6, i.e., no contact is produced between the operation knobs 6 and the cover 20 at the time of their swinging motions in the front-to-rear direction. Flanges 10 projecting toward the front ends 9*b* of the guide members 9 are formed on the front side surfaces 7*f* of the cylinders 7 above the guide members 9. Also, flanges 11 projecting away from the cylinders 7 are formed on the rear side surfaces of the cylinders 7.

As illustrated in FIG. 1, grooves 13 are formed adjacent to the guide members 9. The grooves 13 are positioned between the pairs of the guide members 9 and the pairs of the cylinders 7 arranged in the left-to-right direction L-R and extend in the front-to-rear direction F-B. The grooves 13 have open ends 13*f* to communicate with the left and right side surfaces 1*l* and 1*r* of the case 1. As illustrated in FIG. 3, bottoms 13*b* of the grooves 13 are disposed at the same level as the uppermost portion of the case upper surface 1*u*'.

When raindrops entering through the window which has been left open, beverage accidentally spilt in the vehicle compartment or the like (hereinafter referred to as "water") flows toward above the cover 20 and the operation knobs 6 in the switching device 100 having the above structure, the water enters through the openings 20*c* of the cover 20 into the concaves 20*d* as shown by an arrow in FIG. 6. Then, the water flows downward through the clearances 18 between the cover 20 and the operation knobs 6. The water subsequently drops and collides with the slopes 9*d* of the guide members 9 positioned immediately below the clearances 18. Most of the water instantly flows downward along the slopes 9*d* as shown by bold arrows in FIGS. 3 and 6 to be discharged from the open ends 9*a* of the guide members 9 toward the left and right sides of the case 1. A part of the water flows on the slopes 9*d* toward the cylinders 7 or toward the side opposite to the cylinders 7, or rises along the slopes 9*d* due to the dropping force of the water as shown by fine arrows. The water flowing toward the side opposite to the cylinders 7 falls toward the case upper surface 1*u*' positioned before the guide members 9 as shown by fine arrows. The water flowing toward the cylinders 7 splashes on the side surfaces 7*f* and 8*e* as shown by fine arrows and falls toward the case upper surface 1*u*'. The water rising along the slopes 9*d* falls toward the grooves 13 as shown by fine arrows, passes through the ends 13*f*, and flows toward the case upper surface 1*u*'. The water coming to the case upper surface 1*u*' flows downward along the slope of the upper surface 1*u*' to be discharged from the open ends 1*p* to the left and right sides of the case 1.

As apparent from the above, the guide members 9 having slopes 9*d* inclined in the left and light directions L and R are provided between the case upper surface 1*u*' and the front ends 6*e* of the operation knobs 6. Thus, when water enters from the outside through the clearances 18 between the cover 20 and the operation knobs 6 and falls on the case upper surface 1*u*' in the vicinity of the front ends 6*e* of the operation knobs 6, the water flows along the slopes 9*d* of the guide members 9 to be discharged through the open ends 9*a* of the guide members 9 to the left and right sides of the case 1 as necessary. Accordingly, water is prevented from rising through clearances 19 (FIG. 7) between the operation knobs 6 and the cylinders 7 and entering through the upper and lower openings 7*b* and 7*c* of the cylinders 7 into the case 1.

In the switching device 100, the width of the case 1 in the left-to-right direction L-R is smaller than the width of the case 1 in the front-to-rear direction F-B, and the distance between the cylinders 7 and the left and right side surfaces 1*l* and 1*r* of the case 1 is shorter than the distance between the cylinders 7 and the front and rear side surfaces 1*f* and 1*b* of the case 1. Thus, water can be quickly discharged from the case 1 to the outside by introducing water through the slopes 9*d* of the guide members 9 to the left and right sides of the case 1 by the method described above. Accordingly, entrance of water into the case 1 can be more securely prevented.

The pair of the guide members 9 are arranged in the left-to-right direction L-R in the shape of mountain such that the respective slopes 9*d* of the guide members 9 are inclined downward in the left and right directions L and R. Thus, water falling through the clearances 18 is introduced along the slopes 9*d* in the left and right directions L and R to be discharged to the sides of the case 1 while kept away from the upper openings 7*b* of the cylinders 7 and the front ends 6*e* of the operation knobs 6. Accordingly, entrance of water into the case 1 can be further prevented.

The rear ends 9*c* of the guide members 9 having the front and rear ends 9*b* and 9*c* are disposed close to the cylinders 7 by the predetermined amount from the positions of the front ends 6*e* of the operation knobs 6 and the ends 20*e* of the cover 20. The front ends 9*b* of the guide members 9 are disposed away from the cylinders 7 by the predetermined amount from the positions of the ends 6*e* and 20*e*. In this arrangement, the slopes 9*d* of the guide members 9 are positioned immediately below the clearances 18 between the operation knobs 6 and the cover 20. Thus, water falling along the front ends 6*e* of the operation knobs 6 directly drops on the slopes 9*d*, and instantly flows along the slopes 9*d* toward the sides of the case 1. Accordingly, water is difficult to flow toward the cylinders 7, and thus entrance of water into the case 1 can be further prevented.

Since the rear ends 9*c* of the guide members are disposed adjacent to the front side surfaces 7*f* of the cylinders 7 and the flanges 10 are provided on the front side surfaces 7*f* above the guide members 9, water flows along the slopes 9*d* of the guide members 9 to the sides of the case 1 without staying in the space between the guide members 9 and the cylinders 7. Additionally, even when water on the slopes 9*d* collides with the front side surfaces 7*f* of the cylinders 7 and rises therefrom, the flanges 10 can prevent the water from passing through the clearances 19 between the operation knobs 6 and the cylinders 7 and reaching the upper openings 7*b* of the cylinders 7. Accordingly, entrance of water into the case 1 can be further prevented.

The grooves 13 having open ends 13*f* to communicate with the left and right side surfaces 1*l* and 1*r* of the case 1 are formed adjacent to the guide members 9. Thus, when water rises in directions opposite to the guiding directions of the guide members 9, i.e., in the R direction or L direction opposite to the guiding directions of the guide members 9 due to the dropping force of the water caused by splashing on the slopes 9*d* of the guide members 9, the water enters into the grooves 13 provided in the directions opposite to the guiding directions and does not return to the guide members 9. The water reaching the grooves 13 is then discharged through the open ends 13*f* of the grooves 13 and the case upper surface 1*u*' toward the left and right sides of the case 1. Accordingly, entrance of water into the case 1 can be further prevented.

The case upper surface 1*u*' in the vicinity of the front portions of the guide members 9 are inclined downward to the left and right side surfaces 1*l* and 1*r* of the case 1. Thus, when water flows in directions other than the guiding directions of the guide members 9, i.e., in directions (rising directions R or L of the slopes 9*d*, and transverse directions F-B of the slopes 9*d*) other than the downward directions of the slopes 9*d* (L or R directions) and directly or indirectly flows toward the case upper surface 1*u*', the water does not stay on the case upper surface 1*u*' but flows along the inclined case upper surface 1*u*'. Accordingly, water can be easily discharged from the open ends 1*p* toward the sides of the case 1, and thus entrance of water into the case 1 can be further prevented.

In the above embodiment, one guide member 9 as a wedge-shaped projection as viewed from the front is provided for each operation knob 6 and cylinder 7 between the case upper surface 1*u*' and the front end 6*e* of the operation knob 6 as illustrated in FIGS. 1, 3 and other figures. The invention is not limited to this embodiment, but other shapes such as guide members 9', 9", 9"', and 9"" may be equipped as shown in FIGS. 8 through 11. FIGS. 8 through 11 are front cross-sectional views of the switching device 100 in other embodiments (taken along the line Z-Z in FIG. 2). In these figures, similar reference numerals are given to components and parts similar to those shown in FIGS. 1 through 7, and the components accommodated inside the case 1 are not shown.

Figure 8:
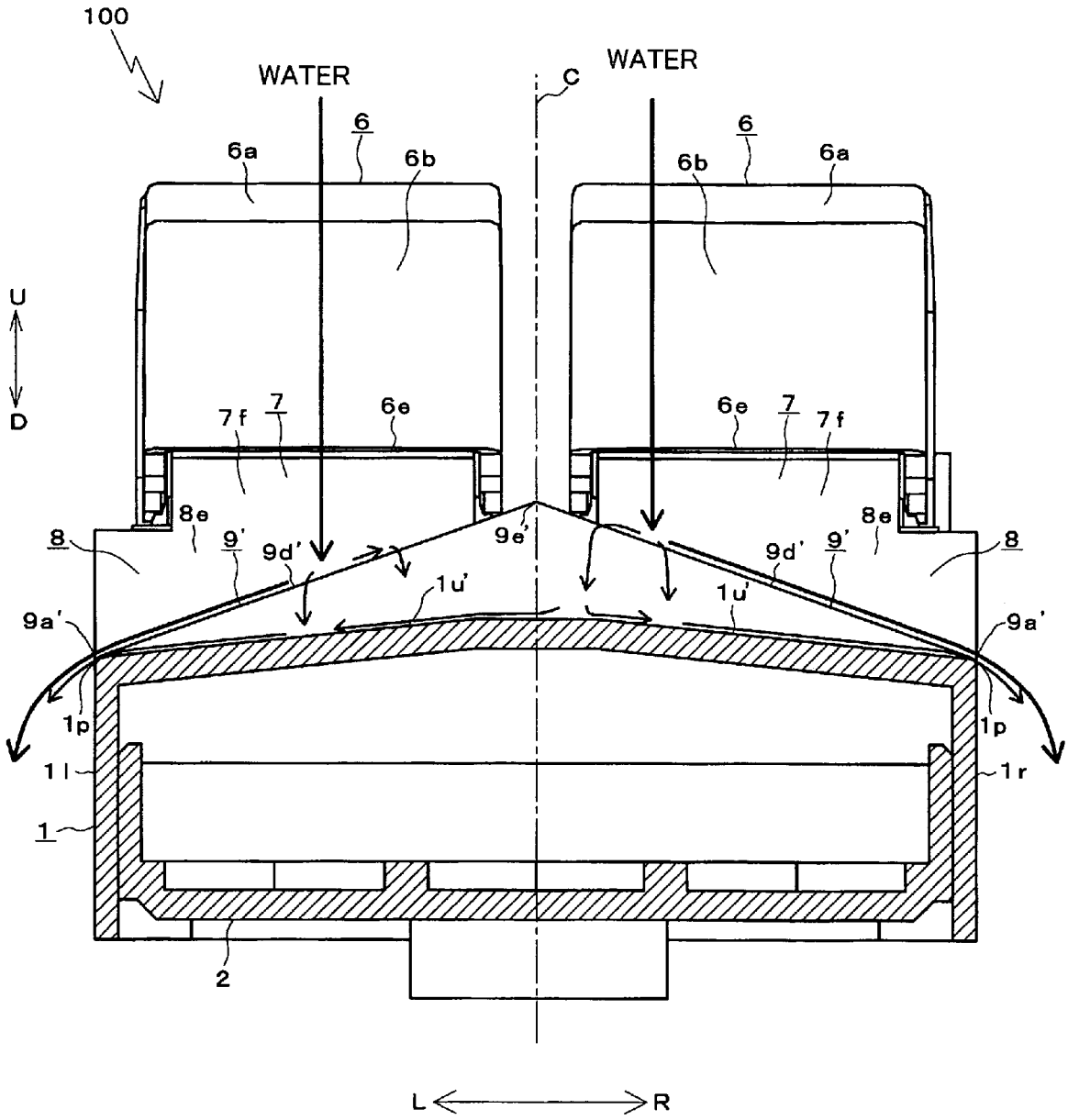
FIG. 8 is a front cross-sectional view of a switching device in another embodiment.

Each of the guide members 9' shown in FIG. 8 has a continuous mountain-shaped projection from a top 9*e*' to ends 9*a*' as viewed from the front. One guide member 9' is provided for two operation knobs 6 and other components (operation knobs 6 and cylinders 7) between the case upper surface 1*u*' and the front end 6*e* of the operation knob 6. The width of the guide members 9' in the front-to-rear direction (vertical direction with respect to the sheet surface of the figure) is equal to that width of the guide members 9. Left and right slopes 9*d*' looking diagonally upward are inclined downward in the left and right directions L and R, and connected to the left and right side surfaces 1*l* and 1*r* of the case 1, providing open ends 9*a*' at the ends of the side surfaces 1*l* and 1*r*.

Figure 9:
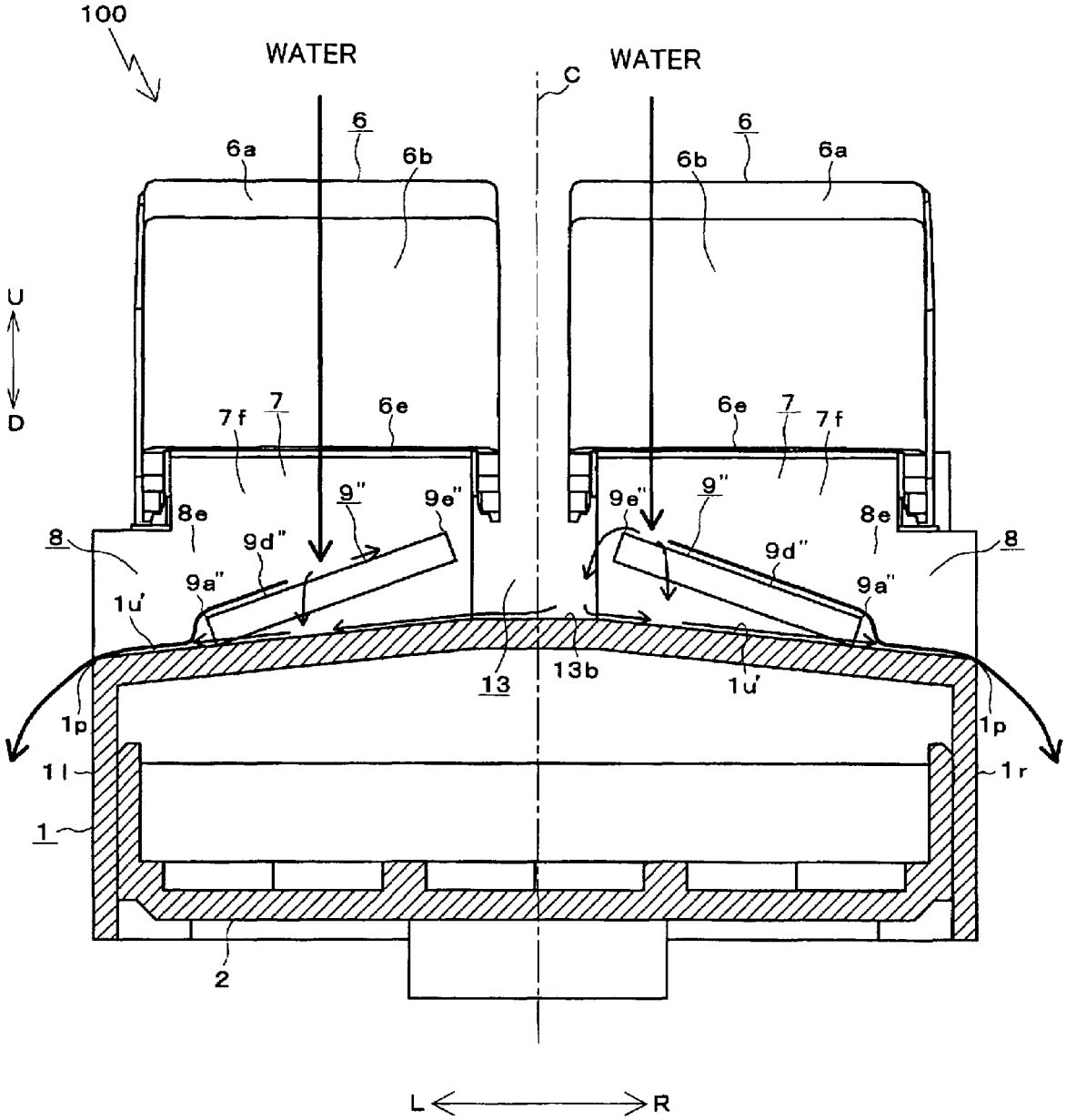
FIG. 9 is a front cross-sectional view of a switching device in another embodiment.

The guide members 9" shown in FIG. 9 are plate-shaped with diagonal inclination as viewed from the front. The guide members 9" vertically project from the rear side surfaces 8*e* of the concaves 8 in the same planes as the front side surfaces 7*f* of the cylinders 7. One guide member 9" is provided for each operation knob 6 between the case upper surface 1*u*' and the front end 6*e* of the operation knob 6. The width of the guide members 9" in the front-to-rear direction is equal to that width of the guide members 9. The width of the guide members 9" in the left-to-right direction L-R is substantially equal to the width of the cylinders 7. Left and right slopes 9*d*" looking diagonally upward are inclined downward in the left and right directions L and R, providing both left and right open ends 9*a*" and 9*e*". The pair of the guide members 9" arranged in the left-to-right direction L-R are line-symmetric with respect to the center line C of the case 1 and form a substantially mountain shape.

Figure 10:
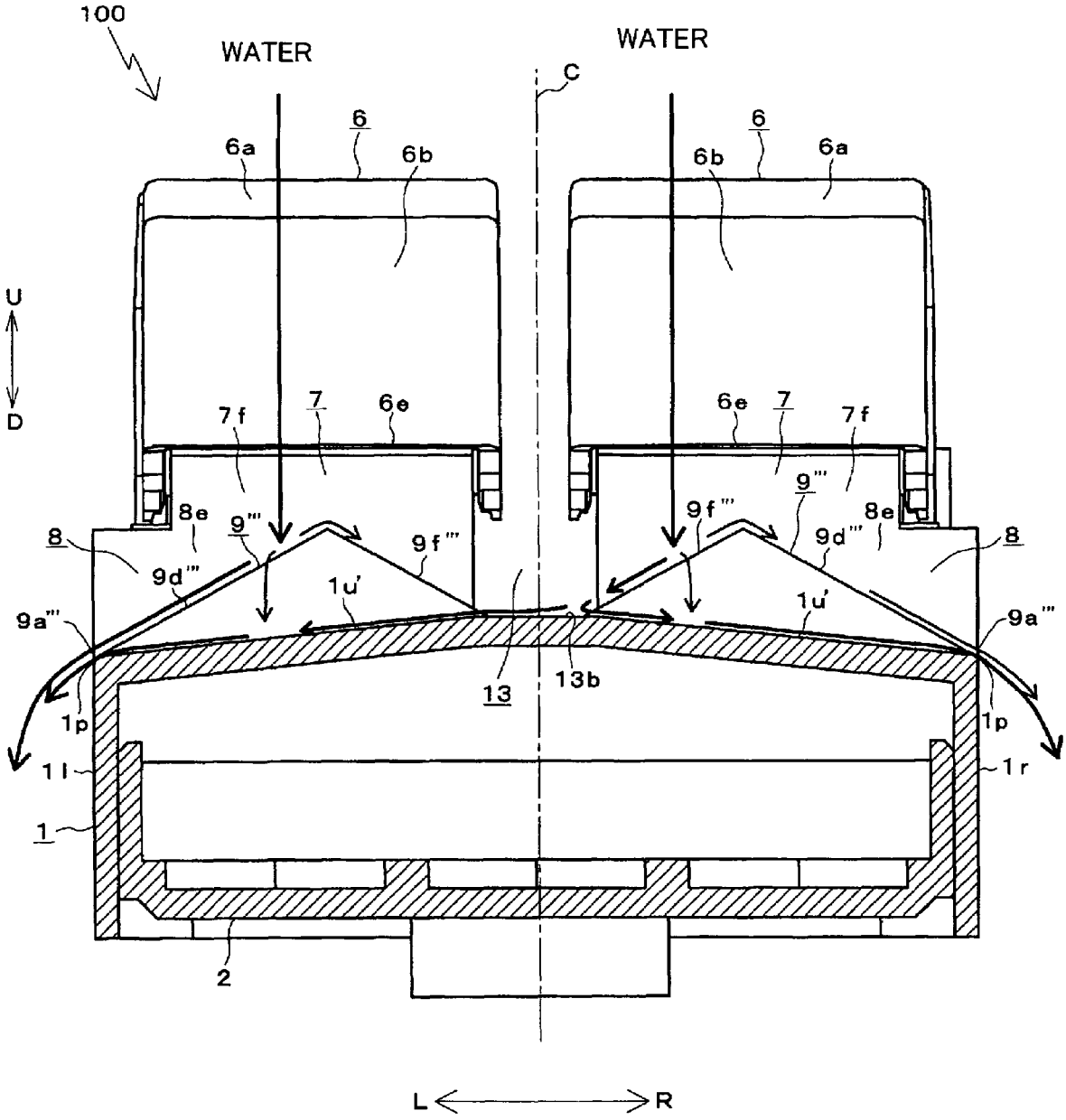
FIG. 10 is a front cross-sectional view of a switching device in another embodiment.

Each of the guide members 9''' shown in FIG. 10 forms a mountain-shaped continuous projection as viewed from the front. One guide member 9''' is provided for each operation knob 6 between the case upper surface 1*u*' and the front end 6*e* of the operation knob 6. The width of the guide members 9''' in the front-to-rear direction is equal to that width of the guide members 9. The width of the guide members 9''' in the left-to-right direction L-R is slightly larger than the width of the operation knobs 6. Left and right slopes 9*d*''' and 9*f*''' looking diagonally upward are inclined downward in the left and right directions L and R. The slopes 9*f*''' facing to the inside of the case 1 are connected to the bottoms 13*b* of the grooves 13, and the flops 9*d*''' are connected to the left and right side surfaces 1*l* and 1*r* of the case 1, providing open ends 9*a*''' at the ends of the side surfaces 1*l* and 1*r*.

Figure 11:
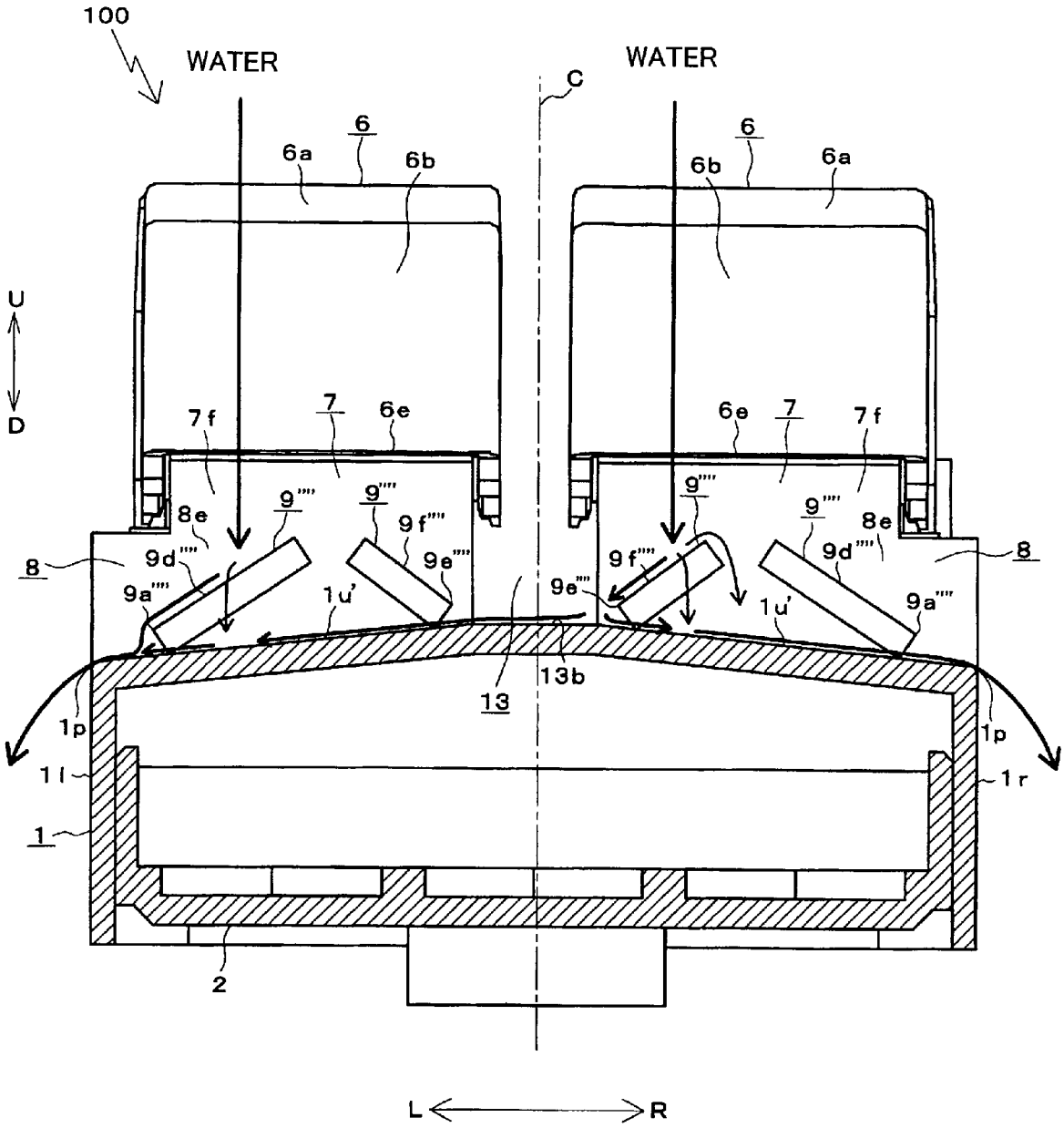
FIG. 11 is a front cross-sectional view of a switching device in another embodiment.

The guide members 9'''' shown in FIG. 11 are plate-shaped with diagonal inclination as viewed from the front. The guide members 9'''' vertically project from the rear side surfaces 8*e* of the concaves 8. Two guide members 9'''' are provided for each operation knob 6 between the case upper surface 1*u*' and the front end 6*e* of the operation knob 6, forming substantially mountain shapes with a predetermined space interposed therebetween in the left-to-right direction L-R. The width of the guide members 9'''' in the front-to-rear direction is equal to that width of the guide members 9. The expanded width of the two guide members 9'''' forming a substantially mountain shape (width from an end 9*a*'''' to an end 9*e*'''') is substantially equal to the width of the cylinders 7. Slopes 9*d*'''' and 9*f*'''' looking diagonally upward are inclined downward in the left and right directions L and R, providing open ends 9*a*'''' and 9*e*''''.

By providing the guide members 9', 9", 9''', 9'''' shown in FIGS. 8 through 11, water entering through the clearances 18 between the front ends 6*e* of the operation knobs 6 and the ends 20*e* of the cover 20 and falling toward the concaves 8 are introduced along the guide members 9', 9", 9''', 9'''' to be discharged toward the left and right sides of the case 1 as necessary as shown by the arrows in the respective figures. Accordingly, entrance of water through the openings 7*b* and 7*c* of the cylinders 7 into the case 1 can be prevented. In the structures having the guide members 9", 9''', and 9'''' shown in FIGS. 9 through 11, there is a possibility that water enters through clearances between each of the guide members 9", 9''', or 9'''', or clearances between the case upper surface 1*u*' and the guide members 9", 9''', or 9''''. However, since the water having entered therethrough flows along the inclined case upper surface 1*u*' to be discharged from the open ends 1*p* toward the left and right sides of the case 1, the water does not stay on the case upper surface 1*u*' or other positions.

In the above embodiments, the guide members 9 are formed integrally with the case 1 in the vicinity of the front ends 6*e* of the operation knobs 6. However, the invention is not limited to this structure. The guide members may be formed integrally with the case in the vicinity of the ends other than the front ends of the operation knobs, or may be formed separately from the case and then attached to the case.

In the above embodiments, the concaves 8 are formed on the case 1 in the vicinity of the front ends 6*e* of the operation knobs 6 to accommodate the guide members 9, 9', 9", 9''', 9'''' between the case upper surface 1*u*' and the operation knob 6. However, the invention is not limited to this structure. The guide members may be disposed in clearances between the case upper surface and the operation knobs, which are widened by attaching the operation knobs to somewhere above the case or by other methods without forming concaves on the case. When the concaves 8 are positioned as in the above embodiments, sufficient spaces are provided between the case upper surface and the operation knobs without raising the attachment positions of the operation knobs to somewhere above the case. In this structure, the height can be reduced and the switching device can be thus miniaturized.

In the above embodiments, the case upper surface 1*u*' in the vicinity of the guide members 9 is connected to both the left and right side surfaces 1*i* and 1*r* of the case 1. However, the invention is not limited to this structure. The case upper surface in the vicinity of the guide members may be connected to only either the left or right side surface of the case. The guide members may be inclined downward in both the left and right directions from the predetermined positions, or may be inclined downward only in either one of these directions.

In the above embodiments, the invention is applied to the switching device 100 having four window open/close switches used in the power window system. However the invention is also applicable to switching deices having only one or more than four window open/close switches, or to switching devices used in door open/close systems or other devices. Furthermore, the invention is applicable to switching devices used for purposes other than vehicle equipment.

What is claimed is:

1. A switching device, comprising:

a switch;

a case within which the switch is accommodated;

a cylinder which is provided on an upper surface of the case and open to above and below to communicate with the inside of the case;

an operation knob which covers an opening of the cylinder and swings in a front-to-rear direction; and an operation bar which extends from the operation knob through the opening into the case to transmit motion of the operation knob to the switch, wherein:

a guide member is disposed between the case upper surface and an end of the operation knob and is inclined in left and right directions so as to guide water toward sides of the case.

2. A switching device according to claim 1, wherein the guide member has a mountain-like shape which is inclined downward in both the left and right directions.

3. A switching device according to claim 2, wherein either a front end or a rear end of the guide member is disposed on a cylinder side with respect to the end of the operation knob and another end of the guide member is disposed on a side opposite to the cylinder side with respect to the end of the operation knob.

4. A switching device according to claim 2, wherein:

either a front end or a rear end of the guide member is disposed adjacent to a side surface of the cylinder; and a flange projecting toward another end of the guide member is provided on the side surface of the cylinder above the guide member.

5. A switching device according to claim 2, wherein a groove having an open end to communicate with left and right side surfaces of the case is formed adjacent to the guide member.

6. A switching device according to claim 2, wherein:

a concave is formed on the case in a vicinity of the end of the operation knob; and the guide member is disposed within the concave.

7. A switching device according to claim 1, wherein either a front end or a rear end of the guide member is disposed on a cylinder side with respect to an end of the operation knob and another end of the guide member is disposed on a side opposite to the cylinder side with respect to the end of the operation knob.

8. A switching device according to claim 7, wherein:

either the front end or the rear end of the guide member is disposed adjacent to a side surface of the cylinder; and a flange projecting toward another end of the guide member is provided on the side surface of the cylinder above the guide member.

9. A switching device according to claim 7, wherein a groove having an open end to communicate with left and right side surfaces of the case is formed adjacent to the guide member.

10. A switching device according to claim 7, wherein:

a concave is formed on the case in a vicinity of the end of the operation knob; and the guide member is disposed within the concave.

11. A switching device according to claim 1, wherein:

either a front end or a rear end of the guide member is disposed adjacent to a side surface of the cylinder; and a flange projecting toward another end of the guide member is provided on the side surface of the cylinder above the guide member.

12. A switching device according to claim 11, wherein a groove having an open end to communicate with left and right side surfaces of the case is formed adjacent to the guide member.

13. A switching device according to claim 11, wherein:

a concave is formed on the case in a vicinity of the end of the operation knob; and the guide member is disposed within the concave.

14. A switching device according to claim 1, wherein a groove having an open end to communicate with left and right side surfaces of the case is formed adjacent to the guide member.

15. A switching device according to claim 14, wherein the case upper surface in a vicinity of the guide member is inclined downward to the left and right side surfaces of the case.

16. A switching device according to claim 15, wherein:

a concave is formed on the case in a vicinity of the end of the operation knob; and the guide member is disposed within the concave.

17. A switching device according to claim 14, wherein:

a concave is formed on the case in a vicinity of the end of the operation knob; and the guide member is disposed within the concave.

18. A switching device according to claim 1, wherein:

a concave is formed on the case in a vicinity of the end of the operation knob; and the guide member is disposed within the concave.

* * * * *